US005390928A

United States Patent [19]

Salini

[11] Patent Number: 5,390,928

[45] Date of Patent: Feb. 21, 1995

[54] GOLFING AID

[76] Inventor: Eraldo V. Salini, 7 Llwyncelyn Road, Glanamman, Ammanford, Dyfed SA18 2AE, Great Britain

[21] Appl. No.: 94,113

[22] PCT Filed: Jan. 29, 1992

[86] PCT No.: PCT/GB92/00168

§ 371 Date: Jul. 29, 1993

§ 102(e) Date: Jul. 29, 1993

[87] PCT Pub. No.: WO92/13607

PCT Pub. Date: Aug. 20, 1992

[30] Foreign Application Priority Data

Feb. 2, 1991 [GB] United Kingdom ..... 9102300
Apr. 11, 1991 [GB] United Kingdom ..... 9107735

[51] Int. Cl.[6] ..... A63B 69/36

[52] U.S. Cl. ..... 273/187.2; 273/189 R

[58] Field of Search ..... 273/187.2, 189 R, 192, 273/187.4, 187.5, 191 R, 191 B, 166, 186.1, 186.2, 162 R, 194 R

[56] References Cited

U.S. PATENT DOCUMENTS 2,273,416 2/1942 Norwood ..... 273/187.2
2,476,489 7/1949 Grandinetti ..... 273/35
2,709,257 5/1955 McKinney ..... 2/16
3,588,105 6/1971 Donohoe ..... 273/32 R
4,575,089 3/1986 Corbett et al. ..... 273/189 A X
4,781,382 11/1988 Hargraves ..... 273/187.2
4,944,516 7/1990 Bickler ..... 273/187.2

FOREIGN PATENT DOCUMENTS 351206 6/1931 United Kingdom ..... 273/162 C

OTHER PUBLICATIONS

International Search Report, Feb. 28, 1992.
International Preliminary Exam Report, Mar. 22, 1993.

*Primary Examiner*—George J. Marlo
*Attorney, Agent, or Firm*—Vickers, Daniels & Young

[57] ABSTRACT

A golfing aid to be used by a person in combination with a golf club is provided. The club includes a ball striking end, a butt-end and a shaft therebetween, the shaft including a gripping portion adjacent the butt-end. The gripping portion is adapted to be held by both the upper and lower hands of a person, with the upper hand adjacent the butt-end and the lower hand spaced from the butt-end. The golfing aid comprises an elongate strap arranged to fit snugly around the upper wrist of the person. A securing mechanism is provided for securing the strap to the upper wrist when the gripping portion is held by both hands. A side arm is arranged to extend from the elongate strap to the butt-end, the securing means adapted to maintain the upper wrist in a controlled position relative to the shaft.

16 Claims, 2 Drawing Sheets

GOLFING AID

The present invention relates to golfing aids.

Problems are often encountered by golfers in maintaining a correct grip on a golf club when a stroke is played, setting the wrists to a correct attitude during the swing, and attaining a full hip/shoulder turn during the swing. Golfing aids aimed at overcoming these problems have previously been proposed; for example, U.S. Pat. No. 4,273,336 describes a golf swing aid which assists in keeping the golfer's wrists together during a swing.

I have now developed a golfing aid which, in addition to obviating incorrect wrist movement and grip pressure, also ensures that for a full and well balanced stroke to be played, a full shoulder and hip turn must be achieved.

According to the present invention, there is provided a golfing aid comprising an elongate strap which can be arranged to fit snugly around a wrist of a user, securing means for securing said strap in position around the wrist of said user, and a side-arm which can be arranged to be secured to the butt end of the shaft of a golf club.

Typically, the strap's length is such that the strap can extend around a user's wrist and further have its longitudinal end portions overlapping. Generally, the strap is padded, and preferably of synthetic material.

Preferably, the golfing aid further comprises a tongue which is generally movable relative to the strap along at least part (usually most) of its length and which extends from a fixed position relative to, or on, a first surface of the strap. The tongue extends in substantially the same direction as the strap having, in use, at least part of its length abutting the first surface of the strap.

Generally, the fixed position from which the tongue extends comprises an anchor member attached to the first surface of the strap. Typically, the anchor member is either an annular member of substantially rectangular shape or a buckle. Preferably, the anchor member is of metal or any other suitably substantially rigid material.

Preferably, the securing means either comprise such a buckle or a multiplicity of hooks or loops arranged to engage a complementary multiplicity of respective loops or hooks. The securing means may, of course, comprise any other suitable fastening device which would allow rapid release of the golfing aid from the user's wrist.

In the case where the securing means comprise a buckle, the strap may be retained in position around the user's wrist by threading the tongue through the buckle. The buckle and tongue are relatively dimensioned such that in use the tongue can be held in a fixed position within the buckle. It is further preferred that a transversely extending band is provided on the first surface of the strap. Typically the band is at least partly spaced from the strap such that, in use, the tongue can be retained contiguous with the strap by passing between opposed facing surfaces of the band and strap.

Alternatively, where the securing means comprise the hook and loop arrangement, the latter are provided on the tongue, the loops and hooks being respectively located at first and second positions along the length of the tongue. Preferably, the tongue comprises opposed outer surfaces connected by edge portions, the loop and hook arrangement being provided on a common outer surface thereof which does not abut the strap in use.

It is preferred that the length of the tongue is greater than that of the strap, so that in use the tongue can extend around the strap (located around the user's wrist) and partially double back on itself.

Preferably, the side-arm extends from the strap and is provided with at least one aperture therethrough. In order to enable a standard golfing aid to be produced which can be used by golfers of any wrist size, the side arm is either adapted to be movable relative to the strap or is provided with a plurality of apertures therethrough. Typically, attachment means are provided which can be arranged in use to extend through an aperture of the side-arm so as to secure the side-arm of the golfing aid to a golf club. Preferably the attachment means comprises a tee or any other device suitable for securing to the golf club (usually by entering a hole normally provided in the butt end of the shaft).

There is further provided by the present invention a kit which comprises a golfing aid as described above and a securing device suitable for attaching said golfing aid to the butt end of a golf club shaft, the securing device being generally attachment means as described above (for example, a tee or the like).

In an alternative embodiment, the side arm may be attached or secured to the butt end of the golf club by means of a resilient annular ring provided on the side-arm and arranged to pass over the butt end of the club. In a further embodiment, a cap having a resilient skirt portion may be provided on the side arm for "press fit" engagement with the butt end of the golf club. In these alternative embodiments, the respective cap and annular ring are typically of a plastics or rubber material.

The invention will now be further illustrated by way of example only, with reference to the accompanying drawings, wherein like parts are denoted by like numerals, and wherein.

Figure 1:
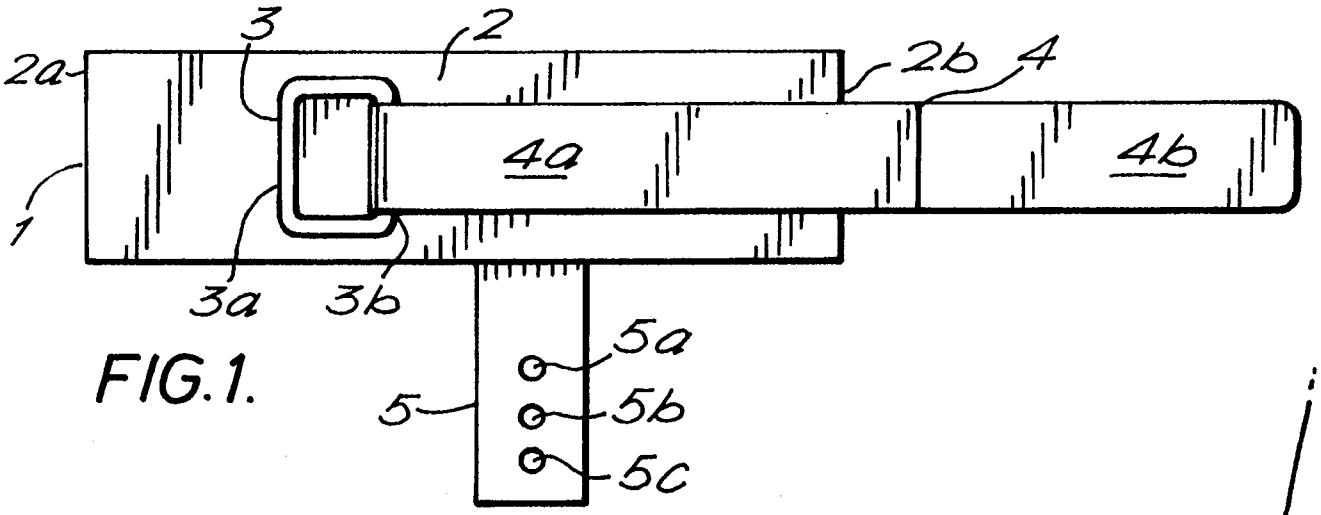
FIG. 1 is a planar view of a first embodiment of golfing aid according to the present invention.

Referring to FIG. 1, a golfing aid generally designated 1 comprises a wrist strap 2 having a rectangular ring 3 attached thereto, a tongue 4 and a side-arm 5 extending from strap 2. Ring 3 has edge portions 3*a* and 3*b* spaced from strap 2 so that tongue 4 can pass around these edge portions. Side-arm 5 is provided with three apertures 5*a*, 5*b* and 5*c* therethrough for receiving a golf tee 6 located in the butt end 7 of a golf club shaft 8. Tongue 4 comprises two sections 4*a* and 4*b*; these sections are typically provided with attachment means (not shown). Typically, the attachment means are of the hook and loop type, whereby a multiplicity of hooks or loops on 4*a* could be arranged to complementarily engage a multiplicity of respective loops or hooks on 4*b*. An example of a suitable material for this purpose is commercially available under the trade mark "Velcro". In use, the strap 2 is arranged around a user's wrist, such that end portions 2*a* and 2*b* usually overlap, tongue 4 extends from edge 3*b* of loop 3 around the surface of strap 2 and passes around edge 3*a*, so that section 4*b* can be folded back on itself whereby the hooks or loops thereon can engage with the complementary respective loops or hooks of 4*a*.

Figure 2:
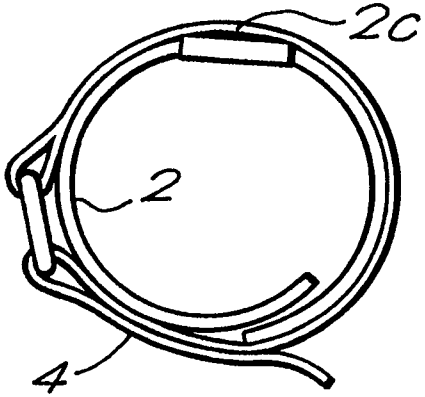
FIG. 2 is a sectional view of the golfing aid of FIG. 1 when arranged for use.

Referring to FIG. 2, in the arrangement shown, strap 2 and tongue 4 are secured in position for use as previously described; strap 2 being held in position by means of a hook and loop fastener, in which the hooks and loops are brought into contact by tongue 4 folding back on itself. Numeral 2*c* denotes the region of strap 2 from which side-arm 5 extends.

Figure 3:
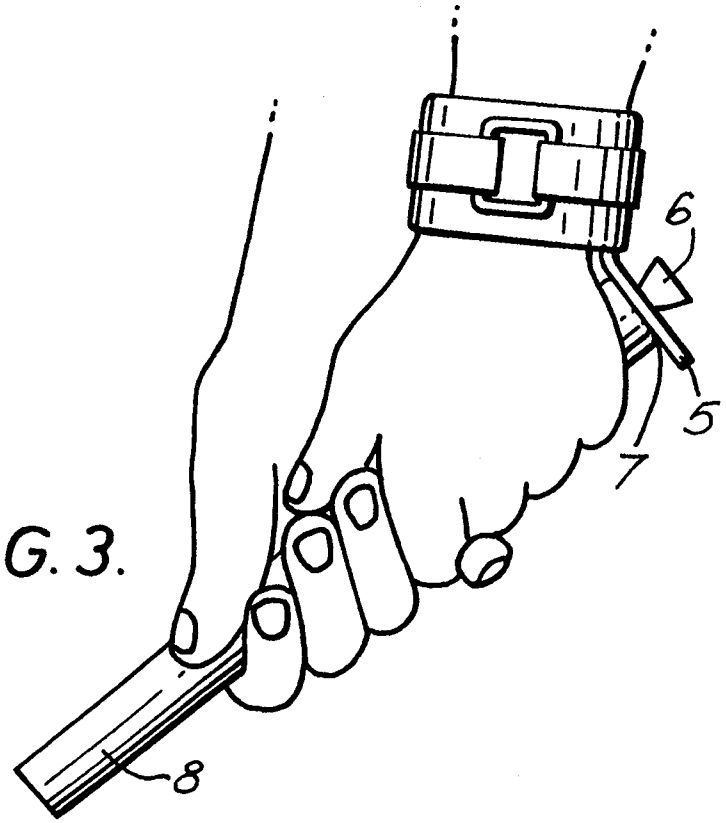
FIG. 3 is a perspective view of the golfing aid of FIG. 1 when arranged for use.

Referring to FIG. 3, golfing device 1 is shown secured around a user's wrist; the device has tee 6 passing through an aperture provided in side-arm 5 and entering a hole (not visible) in the butt end 7 of a golf club shaft 8. This arrangement helps to prevent the wrist of the user's leading arm hinging over excessively when a stroke is played and also helps prevent the butt end of the club shaft moving away from the palms of the user's hand.

Figure 4:
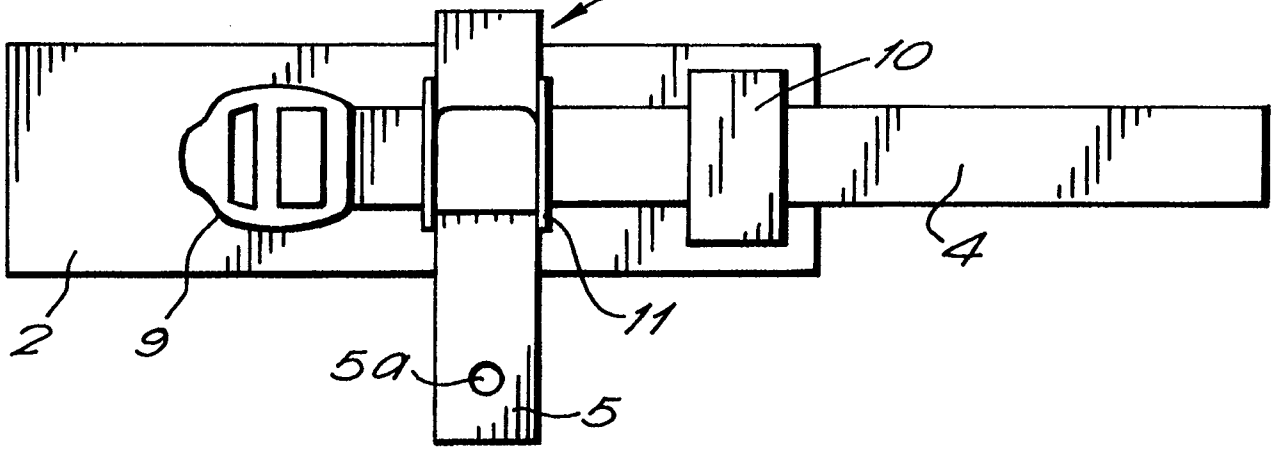
FIG. 4 is a planar view of an alternative embodiment of a golfing aid according to the present invention.

Referring to FIG. 4, a golfing aid generally designated 1 comprises a wrist strap 2 having a buckle 9 attached thereto, a tongue 4 and a side-arm 5 extending from strap 2. Strap 2 is retained around a user's wrist by threading tongue 4 through buckle 9, buckle 9 being dimensioned relative to tongue 4 such that in use buckle 9 holds tongue 4 in a fixed position therein. Band 10 is provided on strap 2 so that tongue 4 can be retained contiguous with strap 2 by passing underneath band 10 between the opposed facing surfaces of band 10 and strap 2. Side-arm 5 is provided with an aperture 5*a* therethrough and is movable relative to strap 2. Side-arm 5 is held in a required position relative to strap 2 by means of cam lock 11.

Figure 6:
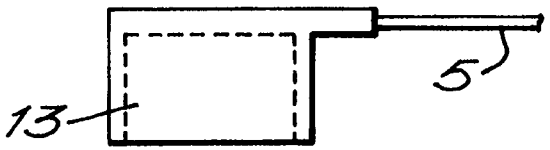
FIGS. 5 and 6 are side views of alternative arrangements of part of a golfing aid according to the invention.
Figure 5:
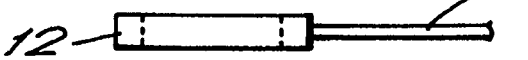

Referring to FIGS. 5 and 6, there are shown alternative means of securing the side arm 5 to the butt end of the golf club. The securing means shown in FIG. 5 comprises an annular rubber ring 12 bonded to the end of the side arm 5. The internal diametrical dimension of the ring 12 is approximately equal to the diametrical dimension of the butt end of a golf club. The securing means shown in FIG. 6 comprises a hollow plastics or rubber cap 13 connected to the side arm 5 and arranged to be press fitted to the butt end of a golf club.

I claim:

1. A golfing aid for use by a person in combination with a golf club, said person having an upper hand, an upper wrist connected thereto and a lower hand, said club including a ball striking head, a butt-end and a shaft therebetween, said shaft including a gripping portion adjacent said butt-end, said gripping portion adapted to be held by said upper and lower hands of said person, said upper hand adjacent said butt-end and said lower hand spaced from said butt-end, said golfing aid comprising an elongate strap adapted to be wrapped around said upper wrist, means for securing said strap to said upper wrist when said gripping portion is held by said hands, a side arm having a length extending from said elongate strap to said butt-end for attachment thereto, said securing means adapted to maintain said upper wrist in a controlled position relative to said butt-end of said shaft when said side arm is attached thereto.

2. A golfing aid according to claim 1, wherein said golfing aid further comprises an anchor member and said strap includes a first surface, said anchor member attached to said first surface of said strap.

3. A golfing aid according claim 2, wherein said anchor member comprises an annular member of a substantially rectangular shape.

4. A golfing aid according to claim 2, wherein said anchor member comprises a buckle.

5. A golfing aid according to claim 4, wherein said securing means comprises said buckle.

6. A golfing aid according to claim 1, which further comprises a tongue each of said tongue and said strap having a length, said tongue adapted to be moveable along a portion of said length relative to said length of strap.

7. A golfing aid according to claim 6, wherein said strap includes a first surface and an anchor member attached to said first surface, said tongue extending from said anchor member.

8. A golfing aid according to claim 6, wherein said length of said tongue is greater than said length of said strap.

9. A golfing aid according to claim 6, wherein said tongue includes at least a first position and at least a second position adjacently arranged on a common outer surface along said length of said tongue, said securing means comprises a multiplicity of loops or hooks arranged to complementarily engage a multiplicity of respective hooks or loops, said hooks and loops being respectively located at said first and said second positions.

10. A golfing aid according to claim 1, wherein said side-arm is provided with at least one aperture therethrough.

11. A golfing aid according to claim 10, further including attachment means adapted to extend through said at least one aperture of said side-arm in order to secure said side-arm to said club.

12. A golfing aid according to claim 11, wherein said attachment means comprises a tee.

13. A golfing aid according to claim 1, wherein said strap further comprises a transversely extending band having opposite ends attached to said strap.

14. A golfing aid according to claim 13, wherein said band is partly spaced from said strap between said opposite ends, said tongue adapted to slide between said band and said strap.

15. A golfing aid according to claim 1, including means for attaching said side arm to said club.

16. A golfing aid according to claim 15, wherein said attachment means comprises a tee.

* * * * *